US007368865B2

(12) United States Patent
Wtyklo et al.

(10) Patent No.: US 7,368,865 B2
(45) Date of Patent: May 6, 2008

(54) CATHODE RAY TUBE WITH A CONICAL PORTION

(75) Inventors: Olivier Wtyklo, Eindhoven (NL); Paul Sterken, Eindhoven (NL)

(73) Assignee: LG Philips Displays, Eindhoven (NL)

( * ) Notice: Subject to any disclaimer, the term of this patent is extended or adjusted under 35 U.S.C. 154(b) by 157 days.

(21) Appl. No.: 10/535,552

(22) PCT Filed: Dec. 24, 2003

(86) PCT No.: PCT/EP03/14909

§ 371 (c)(1),
(2), (4) Date: Nov. 21, 2005

(87) PCT Pub. No.: WO2004/059688

PCT Pub. Date: Jul. 15, 2004

(65) Prior Publication Data

US 2006/0152314 A1 Jul. 13, 2006

(30) Foreign Application Priority Data

Dec. 30, 2002 (EP) ..... 02080585

(51) Int. Cl.
*H01J 29/46* (2006.01)
*H01J 31/00* (2006.01)

(52) U.S. Cl. ..... 313/477 R; 313/490; 313/440; 313/634; 220/2.1 A

(58) Field of Classification Search ..... 313/477 R, 313/440, 493, 634; 220/2.1 A
See application file for complete search history.

(56) References Cited

U.S. PATENT DOCUMENTS

2002/0153823 A1 10/2002 Knoche et al.

*Primary Examiner*—Mariccli Santiago
*Assistant Examiner*—Anthony Perry
(74) *Attorney, Agent, or Firm*—Lahive & Cockfield, LLP

(57) ABSTRACT

A display tube has an evacuated envelope with a display panel, a cone (or funnel) portion and a neck portion. The cone portion has a cone body portion and a parabolic portion. The contour of the cone body in a plane through the longitudinal axis of the tube and the short axis of the panel is such that up to at least half the length of the cone body the cone height sinks by maximally 12%. Hereby stresses at the sealing face between the panel and the cone portion arc reduced. More in particular the Z and Y coordinates of the outer contour are such that at 0.5L=Z it holds that 0.88H<Y<H wherein H is the seal edge position on the short panel axis and L is the depth of the cone portion. Preferably the first and second area show a transition point P between 0.5L and 0.8L.

8 Claims, 6 Drawing Sheets

CATHODE RAY TUBE WITH A CONICAL PORTION

RELATED APPLICATIONS

This application is a 35 U.S.C. 371 national stage filing of International Application No. PCT/EP2003/014909, filed 24 Dec. 2003, which claims priority to European Patent Application No. 02080585.9, filed on 30 Dec. 2002. The contents of the aforementioned applications are hereby incorporated by reference.

The invention relates to a picture display device comprising a display tube having an evacuated glass envelope, which envelope comprises, arranged along a longitudinal axis, a display panel having a short axis and a long axis, provided with a display screen on its inner side, a conical portion and a neck portion, the conical portion being connected to an upstanding wall of the display panel.

Picture display devices of the type described in the opening paragraph are used, inter alia, in television apparatuses and computer monitors and are referred to as cathode ray tubes (CRTs).

Picture display devices of the type described in the opening paragraph are known. Generally they have a (maximum) deflection angle of 110° and a total depth corresponding therewith. E.g. a 110° 32" WSRF tube has a depth of 49.94 cm.

The future Cathodic Ray Tubes should have a reduced depth in order to remain competitive on the market. Going to what is called a slim tube is bringing many technical difficulties. When focusing on the glass components of the tube, it is observed that if the usual design rules are applied the stresses on the glass envelope due to the vacuum load are increasing when the depth is decreasing.

In other words: the shorter the tube, the higher the stresses induced.

A conventional way of reducing vacuum stresses is to increase the glass thickness, which is not cost effective however. CRT glass components should withstand a vacuum load but are also going through a thermal process when assembling the tube components. The thermal process realized induces thermal (temporary) stresses in the glass that can limit the processing time. The so-called thermal stresses are higher with thick glass. In other words: the thicker the glass, the slower the thermal processing of the tube.

One comes then to a fundamental problem: going to slim tubes means thicker glass design to withstand vacuum stress. Thicker glass design means slower processing time (when assembling the tube) involving a lower output of the factory and thus higher costs, and more expensive components.

The problem is thus to find a way to reduce the stress level of a (slim) tube without having to change the glass thickness.

It is an object of the invention to provide a picture display device in which said problem is alleviated.

To this end, the picture display device according to the invention is characterized in that the cross section of the conical portion in a plane through the longitudinal axis and the short axis of the panel has a first area (41) of the conical portion (4) adjacent to the upstanding wall (15) of the display panel (2) which transverses into a second area (42) of the conical portion adjacent to the position where its parabolic curvature ends (end of round), the Z and Y coordinates of the outer contour in said plane being defined suxh that at $$0.5L=Z$$

$$0.88H<Y<H$$

wherein H is the seal edge position on the short axis (in mm), and L is the depth (in mm) of the conical portion along the longitudinal axis from the seal edge towards the end of round position.

The two main glass components of the envelope are:

The cone which is the back part of the tube.

The panel from where the picture can be observed.

These two components are assembled along their sealing surfaces.

The invention applies to one or both of these two components in order to reduce the stress on the most critical area of the tube: the seal edge (interface panel/cone) at the North/South positions.

The Cone Shape:

The cone shape can be simplified if we consider three longitudinal cross sections: North/South, East/West and diagonal. The invention applies to the section North/South (short axis cross section). It consists of making the cone contour (curvature) of this cross section more "bulgy" and is realized by defining the shape of the cone portion in the manner indicated above, whereby up to at least half the length L of the cone as herein before defined the cone body height sinks by maximally 12%. (The contour follows a substantially flat path in the panel sided cone part.)

The parameters that are specified are point coordinates where the outside contour of the short cross axis section should pass: Z and Y, which are depending on H and L (H and L are known values: H is the seal edge position on the North/South axis, and L is the depth of the cone from the seal edge to the so-called end of round area (common term in CRT technology).

Preferably: Z and Y should be such that at:

$$Z=0.5L,$$

$$H>Y\geqq 0.9H$$

most preferably $$H>Y\geqq 0.95H$$

(In other words: the flatter the contour of the panel sided cone part, the better, preferably up to at least half the length L of the cone as herein before defined the cone body height sinks by maximally 10%, even more preferably by maximally 5%.)

Preferably the conical portion shows a transition point P between a flat portion and a steep portion, which transition point lies beyond 0.5L, preferably between 0.5L and 0.8L and for the Y value lies between 0.88H and H, preferably between 0.9H and H, most preferably between 0.95H and H.

The Panel MML Radius:

A parameter that is used during the design of a panel is the position and the contour of the Mould Match Line (MML). The invention specifies a certain value to be used for the radius of the Mould Match Line on the North/South positions.

This radius is MR1.

According to a further embodiment MR1 should preferably be such that $$8500\text{ mm}\leqq MR1\leqq 11000\text{ mm}$$

above MR1 values of 11000 mm the glass manufacturer may encounter problems in making the product.

Figure 7:
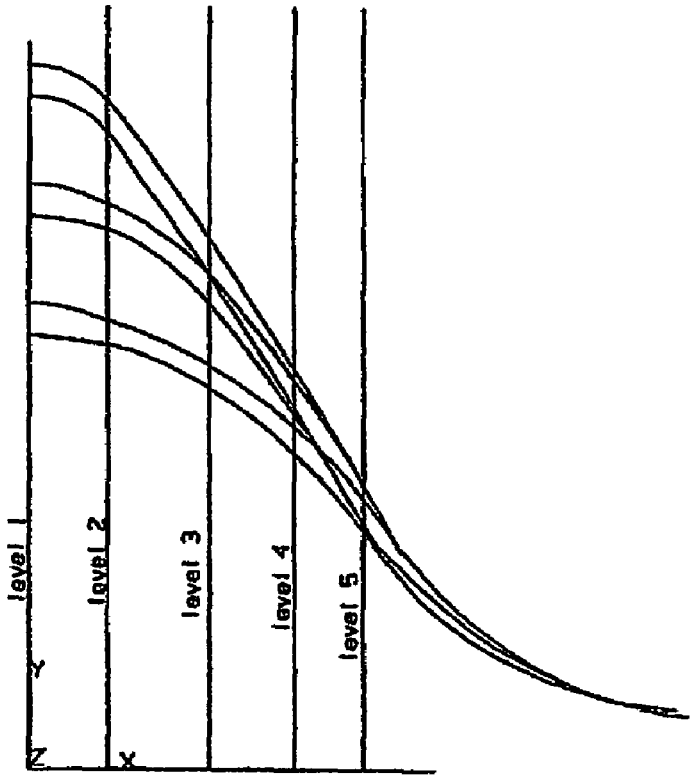
Figure 8:
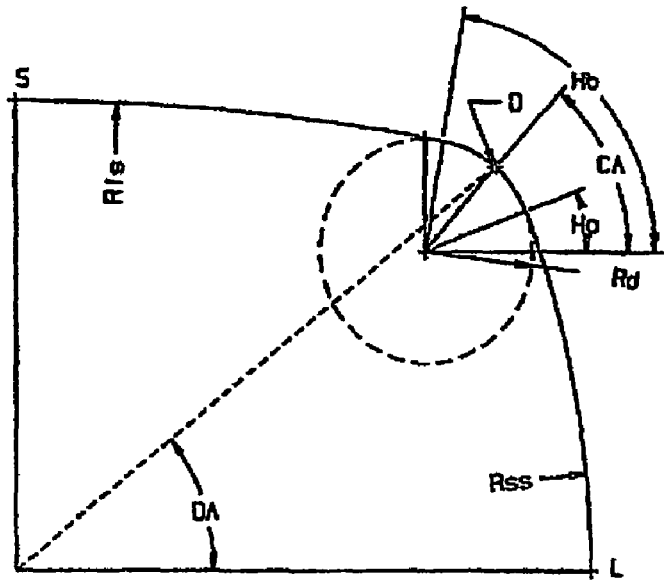

FIGS. 7 and 8 present drawings which are representative for the design phase of a tube.

Figure 9:
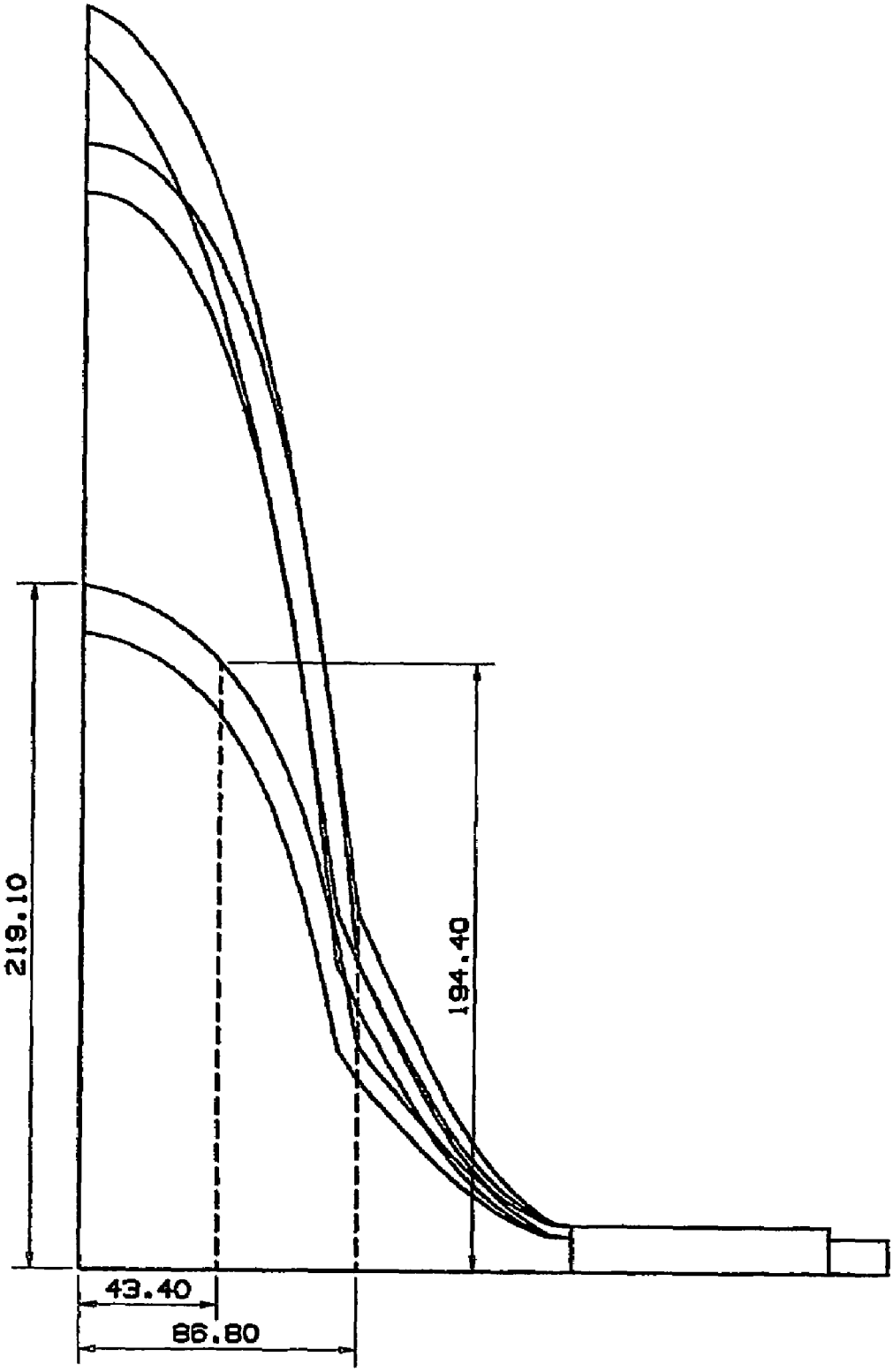

FIG. 9 illustrates yet another example of a cathode ray tube for a display device in accordance with the invention.

The Figures are purely diagrammatic and not to scale. For the sake of clarity, some dimensions have been greatly exaggerated. Similar components are denoted as much as possible by identical reference numerals in the Figures.

Figure 1:
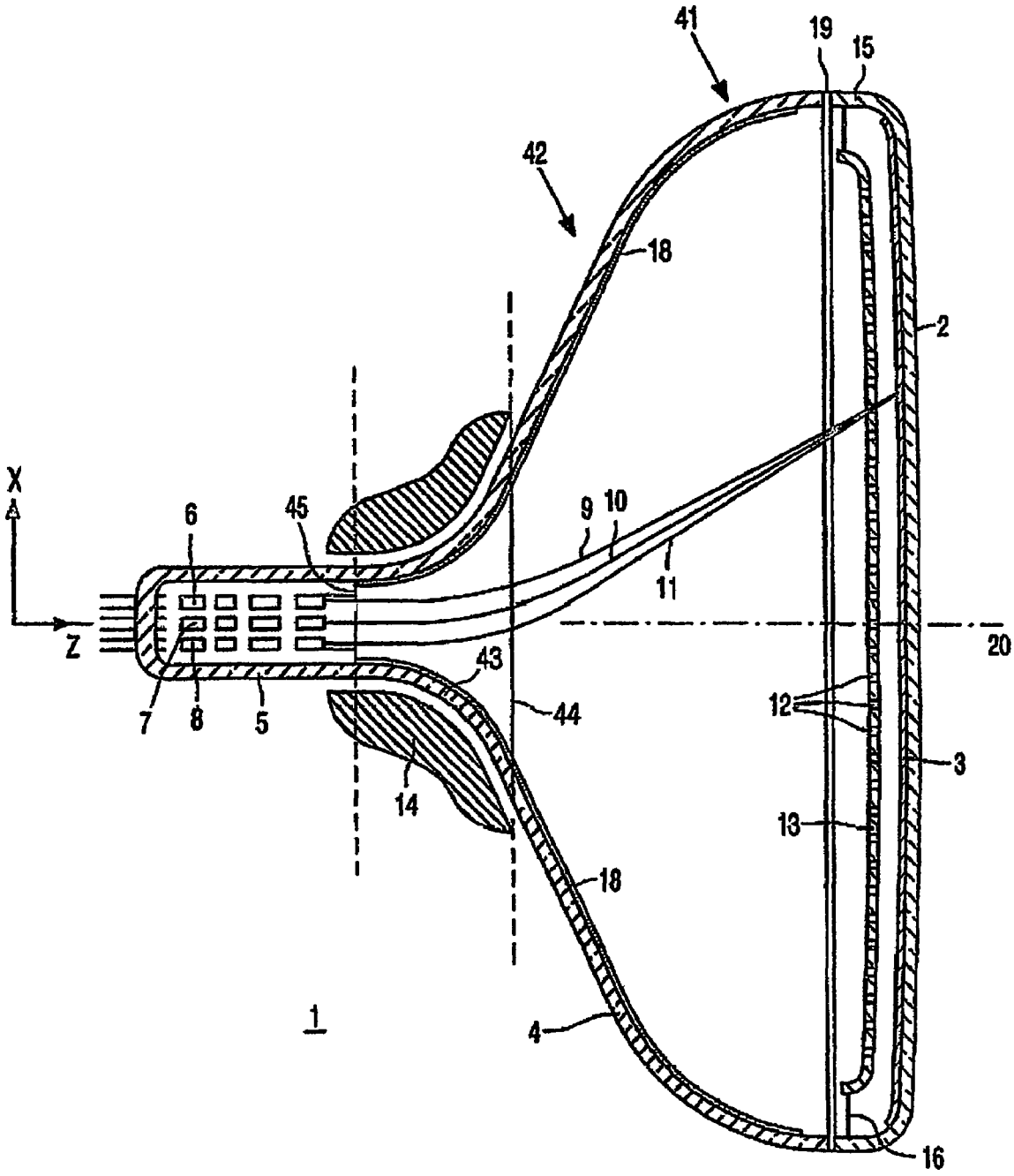
FIG. 1 is a cross-section of a picture display device comprising a cathode ray tube.

FIG. 1 is a diagrammatic cross-section along the longitudinal axis Z and the short panel axis X of a picture display device comprising a cathode ray tube (CRT) having a longitudinal axis 20 and an evacuated envelope 1 comprising a display window 2, a conical portion 4 and a neck portion 5. A display screen 3 is provided on the inner surface of the display window 2. The display screen 3 comprises a large number of red, green and blue-luminescing phosphor elements. In this embodiment, the neck portion 5 comprises three electron guns 6, 7 and 8 for generating three electron beams 9, 10 and 11 which are usually situated in one plane, here the plane of the drawing. On their way to the display screen 3, the electron beams 9, 10 and 11 are deflected in two mutually perpendicular directions (a field and line deflection direction) by the deflection unit 14 across the display screen 3 and pass a color selection electrode 13 arranged in front of the display window 2, which electrode usually consists of a thin plate having apertures 12 and is referred to as shadow mask in this case. CRT's of the slim type have a maximum deflection angle of at least 115 degrees (Nominal 120 degrees). The color selection electrode 12 is suspended to the inner side of the upstanding wall 15 of the display window 2 with the aid of suspension means 16. The connection face between the conical portion 4 and the upstanding wall 15 of the display window 2 is also referred to as the "seal edge" 19 where a (glass) frit is present, which frit serves as a sealing material. The three electron beams 9, 10 and 11 pass the apertures 12 of the color selection electrode 13 at different angles and thus each impinge on phosphor elements of one color only. The inner side of the conical portion 4 is usually coated with a conducting coating 18. The contour of the cone's X-Z cross section has a first area 41 adjacent the upstanding wall 15 of the display panel 2 and a second area 42 adjacent the position 44 where its part 43 (the yoke area) having a parabolic curvature ends L indicates the length of the cone body from the seal edge 19 towards the position 44. The first and second area are designated to indicate the first half and the second half of the conical portion up to the 'end of round'. The position 44 is usually termed "end of round" in the art. This is because the contours of the cross sections of a conventional cone body follow paths according to radiuses.

The cone ends at the position 45, which is also termed the neck seal position.

Figure 2:
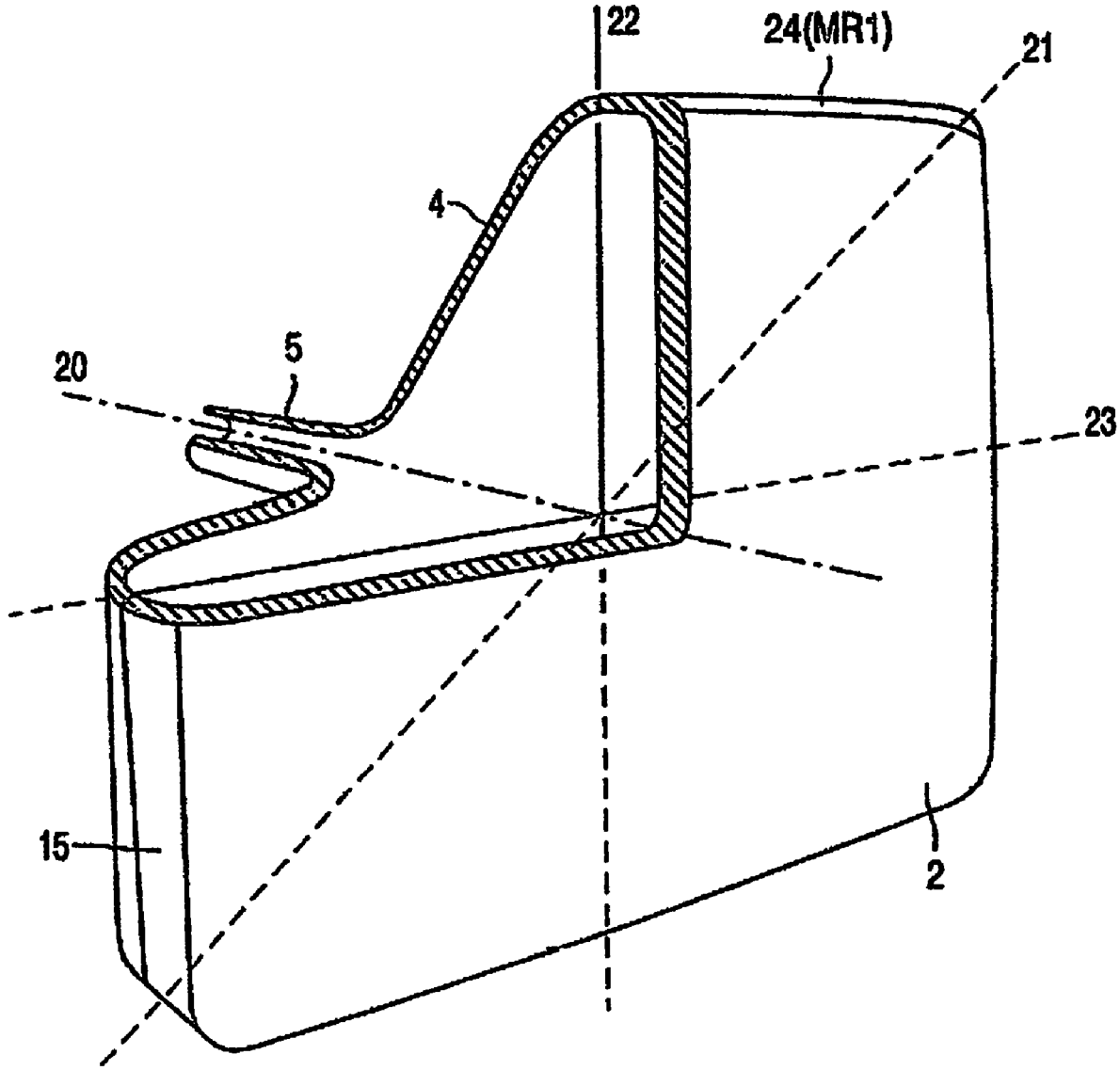
FIG. 2 is a perspective elevational view, partly broken away, of a part of the cathode ray tube of FIG. 2.

FIG. 2 is a perspective elevational view, partly broken away, of a part of the cathode ray tube of FIG. 2, with longitudinal axis 20, display window 2 and upstanding wall 15, conical portion 4 and neck portion 5. For the sake of clarity, some of the components shown in FIG. 1 have been omitted in this Figure. Generally, three main cross sections are considered namely a cross-section ($R_3$) of the conical portion 4 through the longitudinal axis 20 and the diagonal 21 of the display panel, a cross-section ($R_2$) of the conical portion 4 through the longitudinal axis 20 and the short axis 22 of the display panel, and a cross-section ($R_1$) of the conical portion 4 through the longitudinal axis 20 and the long axis 23 of the display panel.

The display panel 2 presents a Mould Match Line (MML) 24 which at the North and South positions of the panel has a radius MR1.

Figure 3:
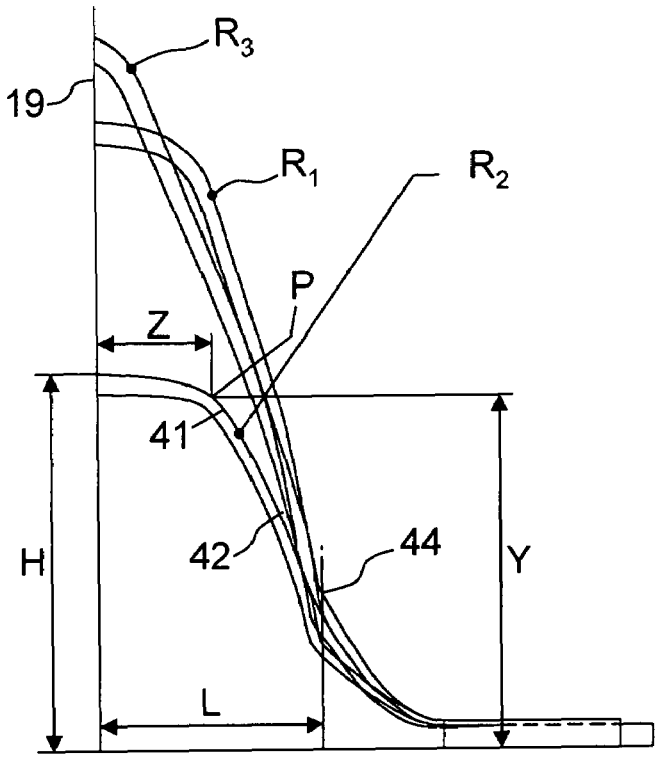
FIG. 3 shows an example of the relevant contours of the conical portion of a cathode ray tube.

FIG. 3 diagrammatically shows the cone contours of the above cross-sections $R_1$, $R_2$ and $R_3$. With respect to the short axis cross section $R_2$ the parameters which are relevant for the invention are specified: H is the seal edge position on the North-South axis, L is the depth of the cone body from the seal edge (19) towards the end of round position (44), while Z and Y are the point coordinates through which the outside curve (contour) of the one should pass. In this example a 32" WSRF cone of the slim type utilizing the invention is represented, for which it holds that H=216 mm; L=122.5 mm, and for Z=62.97 mm (slightly more than L/2) Y=202.33 mm (i.e. Y=0.937 H). At this transition point P the first more or less flat part 41 changes over into a steep part 42. A quite pronounced bend is visible.

In the table below some 32" CRT models+calculations show the effect of the measures according to the invention.

In column I of the table data relating to a conventional 32" CRT cone (not slim) are presented. In this case there is not such an inflexion point as in the inventive cone design. At Z/L=50%, Y/H is smaller than 90%, namely 84%.

In column II data relating to a 32" CRT cone of a similar design, but having a "flatter" Mould Match Line (Radius MR1=9300 mm instead of 6200 mm) are presented. It can be seen that this measure helps to reduce the stresses to a certain extent. (E.g. the tangential stress at the seal edge is reduced by 5%). The thickness was not changed.

In column III data relating to a 32" Slim CRT cone are presented. The data were obtained by scaling the dimensions of the reference tube (column I) to a slim tube, the thickness also being scaled. It can be seen that, compared with the reference tube of column I, the stresses substantially increase.

In column IV data relating to a 32" Slim CRT cone of a similar design as that in column III, but now using the inventive rule on the cone shape, are presented. At the Z-position which complies with Z/L=50%, Y/H is 95% in this case, compared to 84% in the case of the tubes in columns I and II. In going from the column III design to the column IV design the thickness has not been reduced. It can be seen that the vacuum stresses at the critical locations are substantially reduced (compared with the data of column III).

Finally, in column V data relating to a 32" Slim CRT cone of a similar design as that in column IV, but the thickness having been reduced, are presented. The thickness was reduced to an extent to produce stress levels comparable to those in column III. The weight of the cone goes down from 8.8 Kg to 8 Kg, but even important: the weight of the panel goes down from 25.3 Kg to 24.6 Kg. (The panel is twice as expensive as the cone).

So, the invention allows to reduce stresses (going from column III to column IV) involving significant increase of thermal processing speed, or to reduce the cone thickness without increasing the stress level (going from column III to column V), involving lower costs.

H=246.9 mm, L=136.0 mm, with Y/H=0.90 at Z/L=0.50.

Figure 5A:
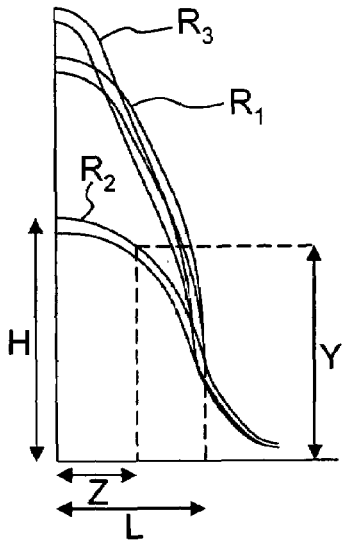
FIGS. 5A and 5B show analogous examples for a first Slim 32" CRT (FIG. 5A) and a second Slim 32" CRT according to the invention (FIG. 5B)
Figure 5B:
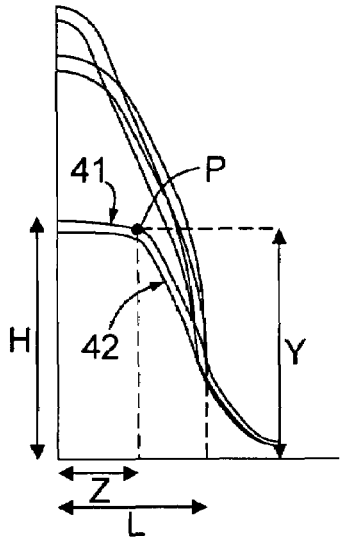

FIG. 5B shows the relevant cone contours of the FIG. 5A design corresponding a more preferred embodiment of the invention. The contour $R_2$ of the short axis section now has the following "index numbers":

H=241.9 mm, L=136.0 mm, with Y/H=0.95 at Z/L=0.50, a transition point P is visible, the coordinates of the transition point P are: Z=68.0 mm; Y=229.2 mm.

TABLE

| | | I | | II | | III | | IV | | V | |
|---|---|---|---|---|---|---|---|---|---|---|---|
| Tube Type | | 32 Inch Reference | | 32" Flat MR1 | | 32" Slim, cone reference scaled | | 32" Slim cone, inventive design 1 | | 32" Slim cone inventive design 2 | |
| Deflection angle | | 108 degrees (normal) | | 106 degrees (normal) | | 117 degrees (slim) | | 117 degrees (slim) | | 117 degrees (slim) | |
| Cone | | Reference cone | | Reference cone adapted to flat MR1 | | Reference cone scaled to slim | | Slim cone, Inventive contour | | Slim cone, thickness optimized | |
| Cone thickness | | Reference thickness | | Reference thickness | | Reference thickness | | Reference thickness | | Thinner design | |
| Radius MR1 | | 8.2 m | | 9.3 m | | 6.2 m | | 6.2 m | | 6.2 m | |
| Inflexion point | H | 220.0 mm | | 217.0 mm | | 220.0 mm | | 220.0 mm | | 220.0 mm | |
| | L | 181.6 mm | | 181.6 mm | | 122.5 mm | | 122.5 mm | | 122.5 mm | |
| | Z | 91.0 mm | | 91.0 mm | | 61.5 mm | | 61.5 mm | | 61.5 mm | |
| | Z/L | 50% | | 50% | | 50% | | 50% | | 50% | |
| | Y | 185.8 mm | | 183.5 mm | | 185.7 mm | | 208.9 mm | | 208.9 mm | |
| | Y/H | 84% | | 85% | | 84% | | 95% | | 95% | |
| Weight | Panel | 25.3 Kg | | 25.0 Kg | | 25.3 Kg | | 25.3 Kg | | 24.6 Kg | |
| | Cone | 10.6 Kg | | 10.5 Kg | | 8.8 Kg | | 9.1 Kg | | 8.0 Kg | |
| Vacuum Stress In Mpa | Seal Edge Radial | 6.9 | 100.0% | 6.7 | 97.1% | 7.3 | 105.1% | 4.4 | 63.8% | 4.3 | 62.3% |
| | Seal Edge Tangential | 6.3 | 100.0% | 6.0 | 95.2% | 10.0 | 158.7% | 8.3 | 131.7% | 9.3 | 147.6% |
| | Cone Outside | 6.9 | 100.0% | 6.7 | 97.1% | 12.7 | 184.1% | 10.5 | 152.2% | 12.5 | 181.2% |

To check further the applicability of the invention, a study was realized on two tube types under development: 28" WSRF (not slim) and 36" WSRF slim. The invention was implemented in the original designs (which follow the conventional design rules) and the reduction of stress checked.

The 28" WSRF tube is a Wide Screen (=9:16 panel aspect ratio) Real Flat tube having a nominal deflection angle of 110° (=not slim type).

Figure 4A:
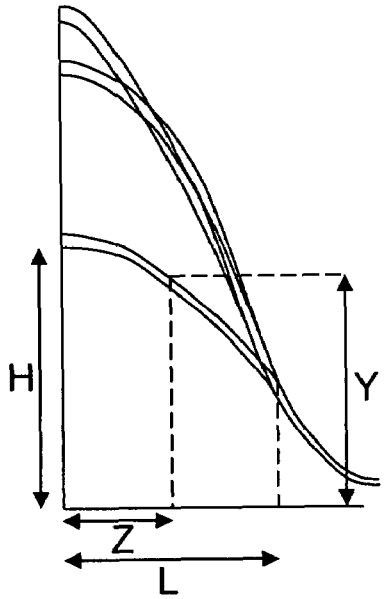
FIGS. 4A and 4B show examples of the contours of a cathode ray tube, measured along the diagonal, the long axis and the short axis cross sections for a conventionally designed 28" CRT (FIG. 4A) and a 28" CRT according to the invention (FIG. 4B)

FIG. 4A shows the relevant cone contours of the original design (the reference). The contour $R_2$ of the short axis section has the following "index numbers";

H=186 mm; L=148 mm, with Y/H=0.86 at Z/L=0.50.

Figure 4B:
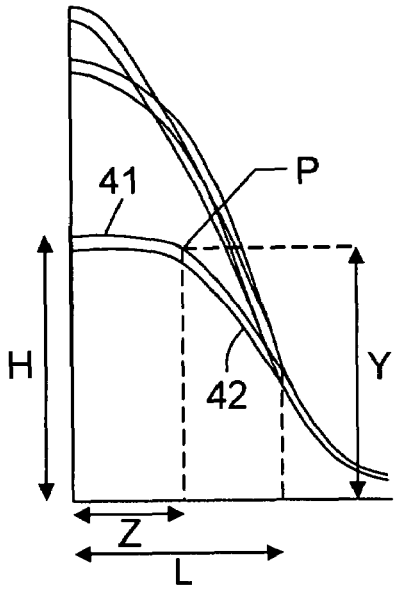

FIG. 4B shows the relevant cone contours of the FIG. 4A design after the invention has been implemented. The contour $R_2$ of the short axis section now has the following "index numbers":

H=186 mm; L=148 mm, with Y/H=0.95 at Z/L=0.50. An bend is visible at transition point P.

Further, the radius MR1 of the Mould Match Line was changed from 4000 to 9000 mm.

Upon comparing the stress pictures of the original tube with the tube implemented with the invention (as regards MR1 and cone shape) a substantial reduction of high stress on the seal edge is observed. The reduction at the critical area (seal edge) is 28% lower stress. This means that also in a not slim (110° deflection angle type) tube the use of the invention has a substantial effect.

The 36" WSRF tube is a Wide Screen Real Flat tube of the nominal 120° deflection angle type (=Slim type).

FIG. 5A shows the relevant cone contours of a first design. The contour $R_2$ of the short axis section has the following "index numbers":

Further MR1 was changed from 7600 mm to 10800 mm. The benefits of the invention allow to reduce the stress and thus the thickness. By adapting the design thickness, the total glass weight could be reduced with 1.2 kg and the seat edge stress was still reduced by 5%.

Figure 6:
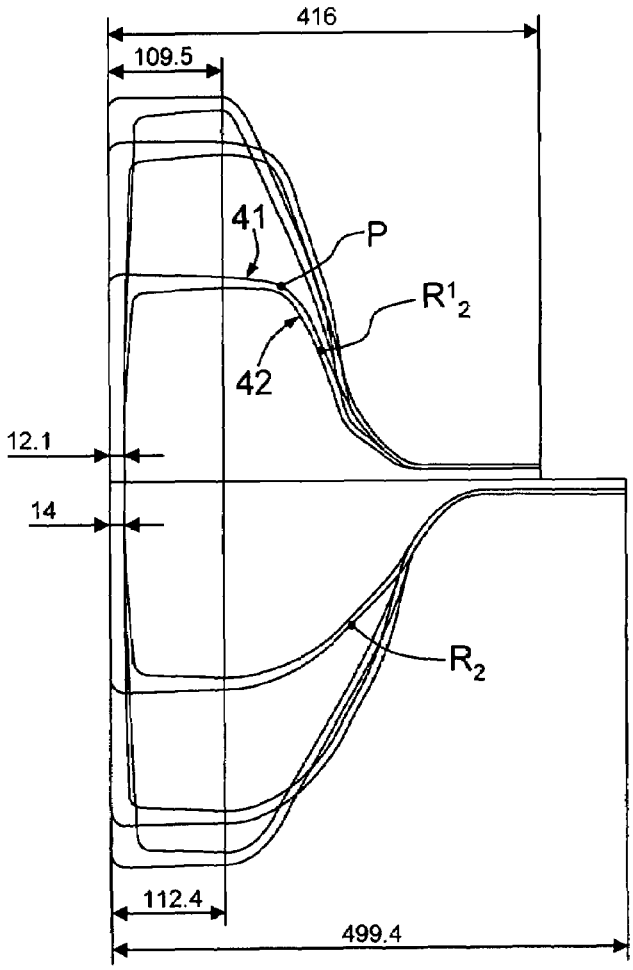
FIG. 6 diagrammatically presents the contours of a conventional 32" Wide Screen Real Flat tube (below) compared with those of a 32" Wide Screen Real Flat tube of the Slim type (above).

FIG. 6 presents a "3 contours" sketch of a 32" Wide Screen Real Flat tube of conventional design (total depth 499.4 mm) in the lower part and of a 32" Wide Screen Real Flat "Slim" Tube according to the inventive design (total depth 416 mm) in the upper part. In the first case the panel portion has a height of 112.4 mm and a front thickness of 14 mm. In the second case the panel portion has a height of 109.5 mm and a front thickness of 12.1 mm.

It can clearly be seen that the contour $R_2^1$ of the vertical section of the inventive cone (or: funnel) body has a pronounced "transition" point P, as compared with the contour $R_2$ of the conventional cone body design which substantially follows a path (arc) having a fixed radius. The latter is more convenient for the tube manufacturer. When a conventional body using a fixed radius is used, the value Y at ½L can be roughly calculated to be $H-0.5^2$(H−Y value at end or round). Typically the Y value at end of round is approximately 0.4H, giving a value of H−0.25×0.6H=0.85H. In the table one can see that indeed for all reference cone a value very close to this estimate (for all cone Y=0.845H at Z=L/2). At half the length of the conical part the cone height for conventional designs sinks by 15%. The cone portion in cross-section is substantially arc-like.

In the inventive design the Y value at Z=L/2 is increased, giving a flatter first part 41 of the cone (the height sinks up to half of the cone length by not more than 12%, preferably not more than 10%, even more preferably not more than 5%), and consequently, since the height at end of round i.e. at L, remains the same, a more steeper second part 42. This gives the cone a more "box-like appearance" and a transition point P between the top (first part 41 for which part the radius of curvature is predominantly pointing downwards) and the side (second part 42 for which part the radius of curvature is predominantly pointing sideways) of the box is evident. At the transition point P the general direction of the radius of curvature changes drastically. The z-value, measured from the edge of the cone-portion, of the transition point P between the top and side of "the box" may lie at or very close to L/2, however, may also lie somewhat beyond L/2, preferably the transition point lies between 0.5L and 0.8L, preferably between 0.5L and 0.6L. The transition point P is the point where the flat upper portion changes over into the steeper side portion. The flatter the design is at the top (i.e. the less the height sinks at L/2) the more pronounced the box-like appearance and the transition point P becomes. Another word that could be used for the transition point P would be for instance the inflection point, from the adjective inflexed, meaning abruptly turned or bent inwards, see e.g Webster's comprehensive dictionary 1996 edition. In each of the designs shown in FIGS. 3, 4B 5B and 6 there is a quite abrupt bend in the contour.

The improvement in terms of stress reduction at the seal edge which is obtainable by the invention as defined in claim 1 can be enlarged somewhat by applying the inventive rule not only to the contour $R_2$ of the short cross section, but also to the contour $R_3$ for the long cross section.

The examples above relate to Wide Screen (16:9) tubes. However, the inventive rule can also be applied to 4:3 tubes if these should be made shallow. As the adaptation of the contour $R_2$ of the short cross section in that case has a less strong effect, adaptation of both $R_2$ and $R_3$ contours can make "the difference".

The design of a cone (or: funnel) body is an iterative process. FIGS. 7 and 8 represent design phases.

General Design Sequence

Phase 1: Creation of the external verticals on the long, short and diagonal sections. This affects the static stress distribution over the funnel.

Phase 2: Creation of the internal verticals on the long, short and diagonal sections. During this process a preferred glass thickness distribution over the funnel is defined.

Phase 3: Horizontal design using a program with which the funnel is defined as a 3-dimensional surface model.

Phase 4: Calculation of the strength of the screen+funnel construction.

Depending on the result of phase 4, phase 1, 2 or 3 may have to be repeated. An average of about 10 iterations are needed before an optimal funnel body design is obtained.

Verticals Design

In FIG. 7 the so-called funnel body verticals are presented.

The design process for the funnel body starts with the definition of the three main sections on the outside. This description may e.g. be performed with:

sections of a circle (conventional), or splines (via measuring points).

Preferably the verticals are designed in the following sequence:

1) short (cross) section
2) diagonal (cross) section
3) long (cross) section

Shape (Contour) of Short Section:

This is conventionally described using a single radius (single arc). In the preferred embodiments of the inventive design an inflexion point P is defined. The further design follows the definition of this point.

The construction method of a 3r contour for a given horizontal section is performed with reference to FIG. 8 (definitions of 3r contour)

Starting Points:

$R_d$=selected diagonal radius

L=distance from tube axis to point on long section;

S=distance from tube axis to point on short section;

D=distance from tube axis to point on diagonal section;

DA=diagonal angle;

CA=construction angle.

FIG. 9 illustrates a further embodiment of the invention. In this embodiment at Z=43.40 mm, i.e. Z=L/2, where L=86.80, the Y value is 194.40 mm, which is 0.89H.

Summarizing, the invention relates to a display tube having an evacuated envelope which comprises a display panel, a cone (or: funnel) portion and a neck portion. The cone portion has a cone body portion and a parabolic portion. The contour of the cone body in a plane through the longitudinal axis of the tube and the short axis of the panel has an inflexion point, such that up to at least half the length of the cone body the cone height sinks by maximally 12%, preferably less than 10%, more preferably less than 5%. Hereby stresses at the sealing face between the panel and the cone portion are reduced. More in particular the Z and Y coordinates of the transition point are such that $$0.5L=Z \text{ and } 0.88H \leq Y < H,$$

wherein H is the seal edge position on the short panel axis (in mm) and L is the depth (in mm) of the cone portion. Preferably an inflexion point P is present, where the outer contour shows a bend.

The invention claimed is:

1. A picture display device comprising a display tube having an evacuated envelope, which envelope comprises, arranged along a longitudinal axis, a display panel having a short axis and a long axis, provided with a display screen on its inner side, a conical portion and a neck portion, the conical portion being connected to an upstanding wall of the display panel through a seal edge, the conical portion having a yoke area having a parabolic curvature, the conical portion being connected to the neck portion, characterized in that the cross section of the conical portion in a plane through the longitudinal axis and the short axis of the panel has an outer contour comprising a first area of the conical portion adjacent to the upstanding wall of the display panel which transverses into a second area of the conical portion adjacent to a position where the parabolic curvature of the yoke area ends, the outer contour having Z and Y coordinates in said plane, the coordinates being defined with respect to an origin positioned at the crossing of the short axis and the longitudinal axis, the outer contour passing through coordinates having values of Z and Y being defined such that at $$0.5L=Z,$$

$$0.88H<Y<H,$$

wherein H is a position of the seal edge on the short axis, L is the depth of the conical portion along the longitudinal axis from the seal edge towards the position where the parabolic curvature of the yoke area ends, Z is a value along the direction of the longitudinal axis, and Y is a value along the direction of the short axis.

2. A picture display device as claimed in claim 1, wherein at $$0.5L=Z,$$

$$0.9H<Y<H.$$

3. A picture display device as claimed in claim 2, wherein at $$0.5L=Z,$$

$$0.95H<Y<H.$$

4. A picture display device as claimed in claim 1, wherein the display panel is a Mould Match Line having an MR1 radius being defined as the radius at the short axis of the display panel, the MR1 radius being defined by the formula:

$$8500\text{ mm} \leqq MR1 \geqq 11000\text{ mm}.$$

5. A picture display device as claimed in claim 1, wherein the first and second area transverse in each other in said plane at a transition point (P), wherein the Z coordinate of the transition point (P) satisfies $$0.5L \leqq Z \leqq 0.8L.$$

6. A picture display device as claimed in claim 1, in which the maximum deflection angle of the display device is at least 115 degrees.

7. A picture display device as claimed in claim 1, in which the display panel has an aspect of ratio of 16:9.

8. A picture display device as claimed in claim 1, in which the display panel is of a Real Flat type.

* * * * *